US005573426A

United States Patent [19]

Grant

[11] Patent Number: 5,573,426

[45] Date of Patent: Nov. 12, 1996

[54] COVERED AUTOMOTIVE JUMPER CABLES

[76] Inventor: George E. Grant, 11739 NE. 128th Ave., Okeechobee, Fla. 34972

[21] Appl. No.: 411,553

[22] Filed: Mar. 28, 1995

[51] Int. Cl.[6] ..... H01R 11/24

[52] U.S. Cl. ..... 439/504; 439/822

[58] Field of Search ..... 439/502, 503, 439/504, 505, 506, 822, 829

[56] References Cited

U.S. PATENT DOCUMENTS

| | | | |
|---|---|---|---|
| 3,267,452 | 8/1966 | Wolf | 439/506 X |
| 3,850,490 | 11/1974 | Zehr | 439/822 |
| 3,853,285 | 12/1974 | Woodring | 242/107.11 |
| 4,272,142 | 6/1981 | Zapf | 439/504 |
| 5,021,008 | 6/1991 | Scherer | 439/504 |
| 5,166,478 | 11/1992 | Sprouse | 439/504 X |
| 5,416,498 | 5/1994 | Hooper | 439/504 X |

FOREIGN PATENT DOCUMENTS

| | | | |
|---|---|---|---|
| 582903 | 9/1959 | Canada | 439/507 |
| 259971 | 12/1985 | Japan | 439/822 |

*Primary Examiner*—Gary E. Elkins
*Assistant Examiner*—Christopher J. McDonald

[57] ABSTRACT

Improved automotive jumper cables (10) having electrical connections to both legs (24) and (26) of handles (14). Each handle (14) has a flexible insulating cover (20). The covers (20) provide added protection against electrical burns, shocks and other accidents. The covers also prevent the handles (14) from becoming entangled with other items when the cables (10) are being moved.

9 Claims, 2 Drawing Sheets

COVERED AUTOMOTIVE JUMPER CABLES

BACKGROUND—FIELD OF INVENTION

This invention relates to automotive jumper cables, specifically to covered automotive jumper cables.

BACKGROUND—DESCRIPTION OF PRIOR ART

Jumper cables are available in various lengths, sizes of electrical wires, shades of colors and degrees of reliability. They have a common problem: the handles are furnished with open ends that become entangled with items, including hooks, wires, ropes, towels and clothing that are encountered as the jumper cables are being moved. Also they have a problem with reliability. The usual cable will have an electrical wire with only one connection to a handle for providing an electrical potential. If the electrical wiring connection is insufficient to permit the flow of electricity from a source to an end use, through the one electrical connection, there will be no advantage in using the jumper cable. Cables are often used by untrained consumers under adverse conditions of rain, cold, and darkness, and the misuse of cables can result in serious physical injury from electrical shock. Cables that become entangled when used arouse the ire of the user and lead to heightened temper and expressions of anger. Such a state of mind reduces the user's ability to function mentally at his best. Therefore, such causes of frustration are to be avoided.

OBJECTS AND ADVANTAGES

Several objects and advantages of the present invention are:

(a) to provide automotive jumper cables whose handles will not become entangled when the jumper cables are being moved;

(b) to provide automotive jumper cables having a plurality of electrical connections on each handle;

(c) to provide covered automotive jumper cables having flexible covers;

(d) to provide covered automotive jumper cables having flexible covers of a variety of colors to enhance their appearance;

(e) to provide a means which prevents the handles of jumper cables from becoming entangled with other objects when the cables are being moved;

(f) to provide jumper cables having additional insulation against electrical shock, fire and explosions.

Further objects and advantages will become apparent from a consideration of the ensuing description and drawings.

DRAWING FIGURES

REFERENCE NUMERALS IN DRAWINGS

Figure 1:
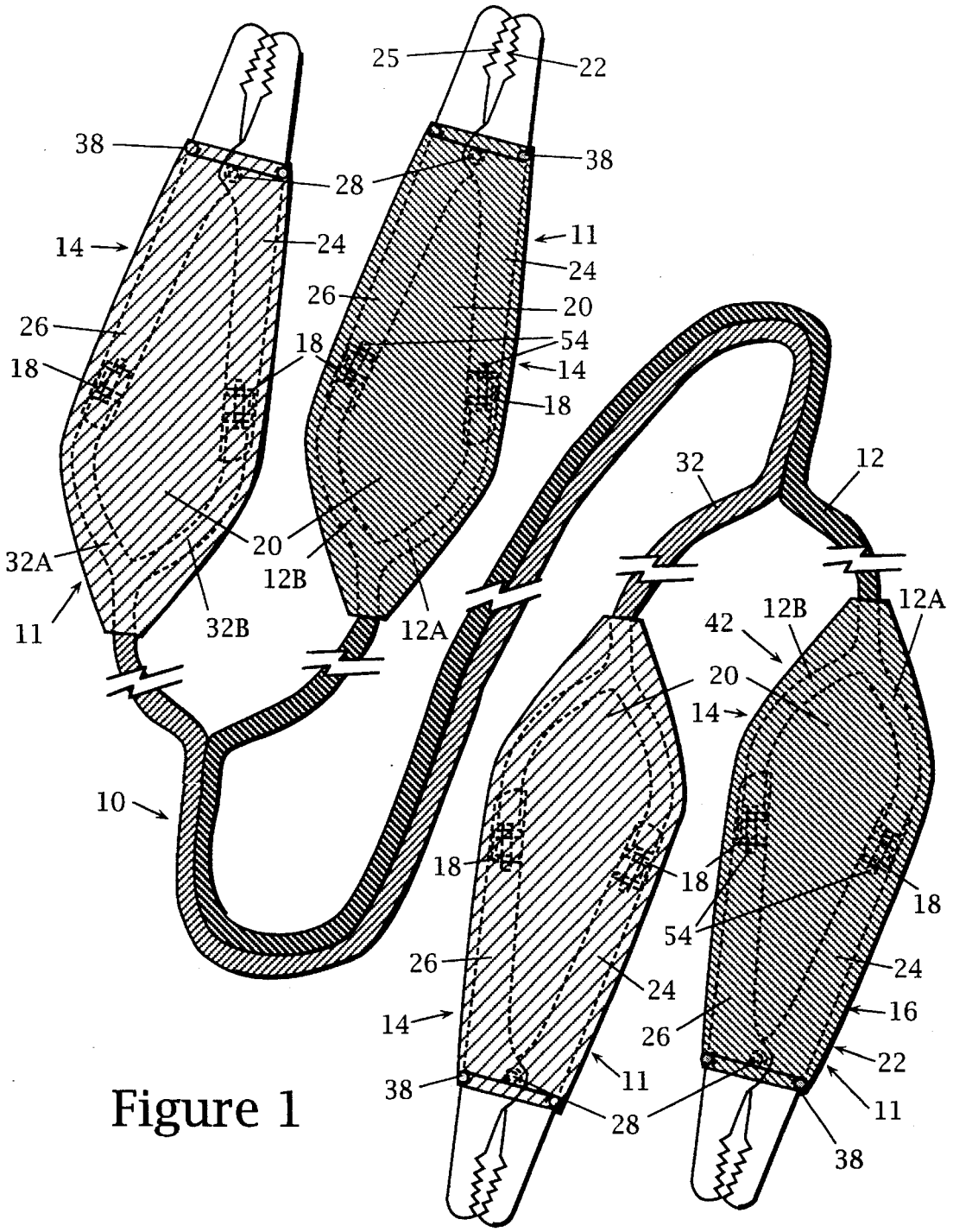
FIG. 1 is a plan view showing a pair of automotive jumper cables wherein the handles are shown contained within a flexible covering.

10 a pair of jumper cables
11 attachments
12 a first cable
**12*a* first component of cable 12**

**12*b* second component of cable 12**
14 handles
18 electrical connectors
20 flexible covering
22 serrated teeth
24 a first elongated leg

REFERENCE NUMERALS IN DRAWINGS, CONTINUED

25 serrated teeth
26 second elongated leg
28 spring loaded pivot pin
29 spring
**29*a*** spring extension
**29*b*** spring extension
32 a second cable
**32*a* first component of cable 32**
**32*b* second component of cable 32**
38 reinforcement band
44 side of connector
46 side of connector
48 top area of connector
50 hole in side 44
52 hole in side 46
54 area for fusion welding
56 stripped area of cable **12*a***

Figure 2:
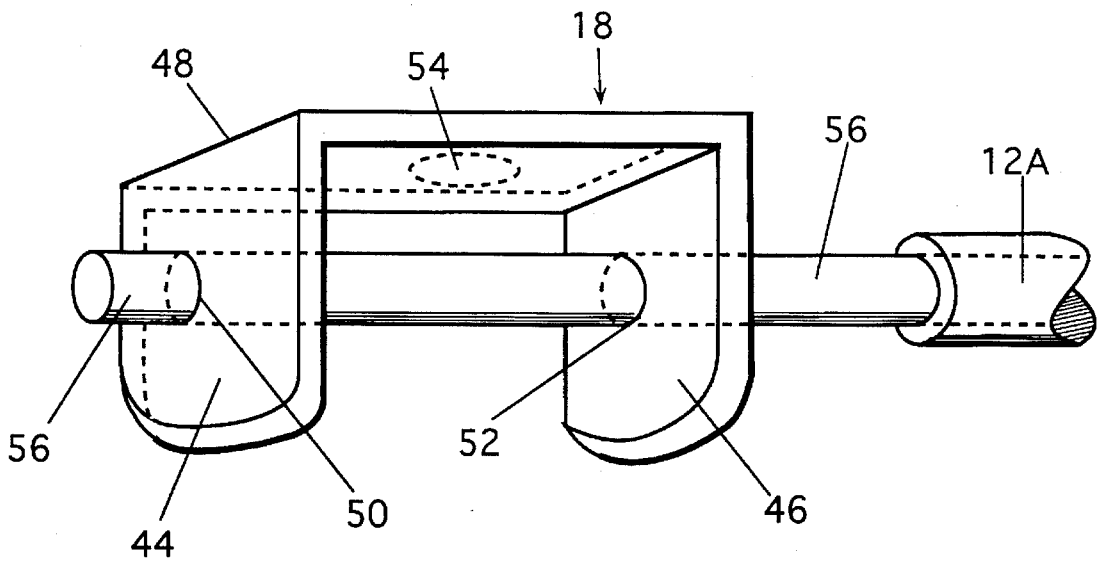
FIG. 2 is a perspective view of a fitting for connecting and holding the electrical cable to the handle.
Figure 3:
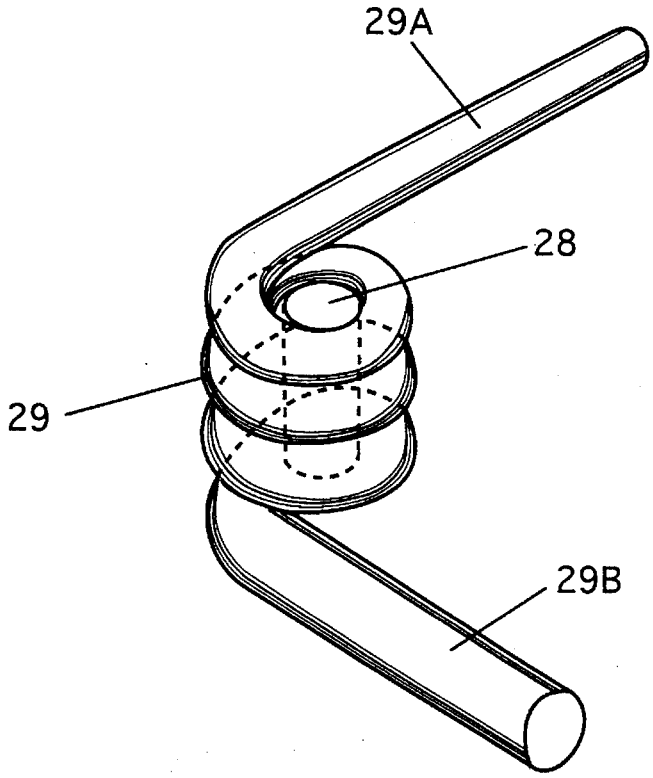
FIG. 3 is a perspective view of a spring loaded pivot pin.

DESCRIPTION OF FIGS. 1, 2, and 3

A typical embodiment of the flexibly covered jumper cables of the present invention is illustrated in FIGS. 1, 2 and 3. FIG. 2 shows a metal electrical connector 18, having a flexible side area 44, a flexible side area 46, and a top area 48. Sides 44 and 46 contain a hole 50 and a hole 52 respectively. Also shown in FIG. 2 is a stripped portion 56 of a cable component **12*a* protruding through holes 50 and 52**.

FIG. 3 shows a spring 29, coiled around a pivot pin 28. Spring 29 has a spring extension **29*a* and an extension 29B that fit into an elongated leg 24 and an elongated leg 26 respectively. Coiled spring 29 causes elongated legs 24 and 26 to oscillate around pivot pin 28 and to be open as shown in FIG. 1**. Similar coiled springs are old in the art.

FIG. 1 shows a pair of jumper cables 10 comprising a cable 32 and a cable 12, the cables having a group of attachments 11, identical except for colors, on each end of each cable. Attachments 11 on the top end of cable 12 include two electrical connectors 18, a handle 14 and a flexible covering 20. Handle 14 consists of a first elongated leg 24, a second elongated leg 26, a spring loaded pivot pin 28, a spring 29 (See FIG. 3) and a reinforcement band 38. The color of handles 14 and flexible coverings 20 on cable 12 may be different from similar handles and coverings on cable 32. The means for securing attachments 11 on each end of cable 12 and cable 32 are identical. The ends of cable 12 are split into a component **12*a* and a component 12*b*. Legs 24 and 26 each have an electrical connector 18, shown in FIG. 2, attached to their underside area. Connectors 18 may be attached by fusion welding or by other methods known in the art. In FIG. 2, an area 54 is designated as an area for applying spot or fusion welding for attaching connector 18 to the inside area of leg 24. Component 12*a* is attached to connector 18 in leg 24 and component 12*b* is attached to connector 18 in leg 26. FIG. 2 illustrates the means of attaching cable 12*a* to connector 18. The stripped portion 56 of component 12*a* protruded through holes 50 and 52 of sides 44 and 46 respectively. Sides 44 and 46 are not normally parallel with each other. In order for stripped portion 56 to protrude through holes 50 and 52, it is necessary that sides 44 and 46 be manually held in parallel position until stripped portion 56 is manually pushed through holes 50 and 52. When stripped portion 56 has been manually pushed through holes 50 and 52, sides 44 and 46 are manually released and assume an unparallel position. In the unparallel position, sides 44 and 46 hold stripped portion 56 in a secure position and provide contacts for transferring electrical potential. Component 12***b* is attached to connector 18, inside leg 26 in a similar manner as described above. Elongated legs 24 and 26 contain a plurality of serrated teeth 22 and a plurality of serrated teeth 25 respectively. Spring loaded pivot pin 28 is designed to cause legs 24 and 26 to pivot and oscillate on pin 28. Spring 29 is old in the art. In the normal state, spring 29 causes the open ends of legs 24 and 26, containing cable portions 12*a* and 12*b* respectively, to remain in the open position as shown in FIG. 1. Also in the normal state, the ends of legs 24 and 26 containing serrated teeth 22 and 25 respectively are in the closed position as shown in FIG. 1. Flexible covering 20 surrounds a predetermined portion of cable 12 to the area just before it is split into components 12*a* and 12*b*. Covering 20 also encloses the two components 12*a* and 12*b* and a predetermined portion of legs 24 and 26. Covering 20 is attached to handle 14 by reinforcement band 38. Covering 20 may be made from materials including rubberized material, knitted material, plastic material and any other material that would remain flexible and remain in place. Covering 20 may be held in place by reinforcement bands such as band 38 or by velcro material or by fabric selvage or by elastic material of other suitable adjustable material. The previous description of parts and how they are attached to each other is applicable and identical to parts that are attached to each of the ends of cables 12 and 32. Any of the parts may vary in color, size, density, and quality.

OPERATION—FIGS. 1 and 2

The manner of using the covered jumper cable is identical to that for jumper cables in present use. However, with the covered jumper cables the open ends of handles such as handle 14 are encased in flexible material that will permit the usual use of the handle without the problems of hooking and ensnaring other objects while the cables are being removed from storage, used and replaced into storage.

With handle 14 enclosed in flexible material, it may be manually pressed together to open the area containing serrated teeth 22 and 25. The opened serrated teeth 22 and 25 are placed around a battery pole, not shown, then handle 14 is released manually and spring 29 causes the serrated teeth 22 and 25 to grip the battery pole. Each end of jumper cable 10 operates identically to the above description.

SUMMARY, RAMIFICATIONS AND SCOPE

Accordingly, the reader will see that the flexibly covered jumper cables of this invention can be successfully used without ensnaring other objects while the cables are being retrieved from storage, while the cables are being used or while the cables are being restored.

The use of jumper cables is normally at a time when something unexpected has happened and has unpleasantly interrupted one's plans. To have an electric battery with low electrical potential tends to arouse one's ire. To recognize the need to use jumper cables tends to increase one's anxiety. A smooth retrieval and use of jumper cables, without entanglement with other items in so doing, can be a relief and a pleasure and can add immeasurably to one's inner feelings.

Electrical burns and shocks, fires and explosions are a few of the hazards one encounters while using jumper cables. The covered handles of this invention provide additional protection against the main hazards encountered while using jumper cables. It is likely that lives have been lost which would have been saved through the use of this invention.

Applicant submits that this invention is new. A search of the prior art discloses that there are no automotive jumper cables with flexible handle coverings available. Applicant also submits that this invention is useful. Its use prevents accidents. Its use gives the user a secure feeling of confidence that the cables can be used without entanglements with other items. This invention is useful because it can and will be used successfully by people with variable abilities. A matured person could safely ask a preteen person to retrieve the cables from their storage area and expect no trouble in doing so.

Applicant further submits that the use of this invention produces unexpected results. The user of regular jumper cables expects to have the cables entangled with other objects; to not do so is an unexpected result.

Although the description above contains some specificities, these should not be construed as limiting the scope of the invention but as merely providing illustrations of some of the preferred embodiments of this invention. Thus the scope of the invention should be determined by the appended claims and their legal equivalents, rather than by the examples given.

I claim:

1. Automotive jumper cables comprising a first cable for carrying a negative electrical current, a second cable for carrying a positive electrical current, a handle on each end of the cables; each of the handles comprising a first elongated member, an electrical connector rigidly attached to the first elongated member, a second elongated member, a second electrical connector rigidly attached to the second elongated member, means for carrying an electrical current through each elongated member comprising split ends of a predetermined distance on each end of each cable, the split ends consisting of a first component and a second component, the first component of the split ends being aligned with and attached to the electrical connector inside the first elongated member; the second component of the split ends being aligned with and attached to the electrical connector inside the second elongated member; each of the handles further comprising a pivot pin; a spring entwined about the pivot pin; aligned matching holes in the sides of the first elongated member and the sides of the second elongated member, through which the pivot pin extends providing a means by which the elongated members are joined together and upon which they pivot, the spring forcing the elongated members to close at one end while forming an open end at the opposite end of the elongated members; the jumper cables further comprising a flexible covering over the open ends of each of the handles.

2. Automotive jumper cables comprising a first cable for carrying a negative electrical current, a second cable for carrying a positive electrical current, each of the cables having a handle mechanically and-electrically connected to each end of said cables; each of the handles comprising a first elongated member having a plurality of serrated teeth for aiding in the attaching of said handle to a battery pole, the first elongated member further comprising an electrical connector rigidly attached to the first elongated member and to an end of the cables; a second elongated member having a plurality of serrated teeth for aiding in the attaching of said handle to the battery pole, the second elongated member further comprising an electrical connector rigidly attached to the second elongated member and to an end of the cables; means for carrying an electrical current through each elongated member to the respective serrated teeth and to the battery pole; each of the handles further comprising a pivot pin, a spring entwined about the pivot pin, aligned matching holes in the sides of the first elongated member and in the sides of the second elongated member through which the pivot pin extends providing a means by which the elongated members are joined together and upon which they pivot, the spring forcing the elongated members to close at one end while forming an open end at the opposite end of the elongated members.

3. The jumper cables of claim 2 wherein the means for carrying an electrical current through each elongated member to the respective serrated teeth and to the battery pole comprises split ends of a predetermined distance on each end of each cable, the split ends having a first component and a second component, the first component of the split ends being aligned with and attached to the electrical connector inside the first elongated member; the second component of the split ends being aligned with and attached to the electrical connector inside the second elongated member, said current flows through each split end, through the respective electrical connector. through the respective elongated member, through the respective serrated teeth, to said battery pole.

4. The jumper cables of claim 2 further comprising means for preventing the handles of said cables from becoming entangled with other objects when the cables are being moved through an area having objects with which the handles may become entangled.

5. The jummper cables of claim 3 further comprising means for preventing the handles of said cables from becoming entangled with other objects when the cables are being moved through an area having objects with which the handles may become entangled.

6. The jumper cables of claim 4 wherein the means for preventing the handles of said cables from becoming entangled with other objects comprises a flexible covering over and fastened to the open ends of each of the handles.

7. The jumper cables of claim 5 wherein the means for preventing the handles of said cables from becoming entangled with other objects comprises an insulating, flexible covering over and fastened to the open ends of each of the handles.

8. The jumper cables of claim 7 wherein the flexible covering may be of any color.

9. The jumper cable of claim 8 wherein the flexible covering may be of any design.

* * * * *